US007965199B2

(12) United States Patent
Moon

(10) Patent No.: US 7,965,199 B2
(45) Date of Patent: Jun. 21, 2011

(54) VEHICULAR SIGNATURING APPARATUS AND ASSOCIATED METHODOLOGY

(75) Inventor: James Neil Moon, Sterling Heights, MI (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 433 days.

(21) Appl. No.: 12/033,265

(22) Filed: Apr. 2, 2008

(65) Prior Publication Data

US 2009/0251335 A1 Oct. 8, 2009

(51) Int. Cl.
*G08G 1/01* (2006.01)

(52) U.S. Cl. ..... 340/933; 382/103

(58) Field of Classification Search ..... 340/933, 340/937, 942; 382/103; 348/148, 149
See application file for complete search history.

(56) References Cited

U.S. PATENT DOCUMENTS

| | | | | |
|---|---|---|---|---|
| 5,590,217 | A * | 12/1996 | Toyama | 348/149 |
| 5,796,094 | A * | 8/1998 | Schofield et al. | 250/208.1 |
| 6,118,383 | A | 9/2000 | Hegyl | |
| 2005/0058323 | A1 * | 3/2005 | Brodsky | 382/103 |
| 2005/0088320 | A1 * | 4/2005 | Kovach | 340/933 |
| 2009/0021581 | A1 * | 1/2009 | Sun et al. | 348/148 |

* cited by examiner

*Primary Examiner* — Thomas J Mullen

(57) ABSTRACT

A vehicular signaturing device and associated methodology by which to identify a vehicle. A sensor senses light energy emitted by the vehicle, such as light energy generated by a headlight assembly of the vehicle. The sensed energy is compared with database-stored information that is indexed together with standard vehicular types, models, and manufacture-year to identify the vehicular type. Once identified, the information related to identification is used pursuant to further vehicular-signaling functionality.

20 Claims, 7 Drawing Sheets

VEHICULAR SIGNATURING APPARATUS AND ASSOCIATED METHODOLOGY

The present specification relates generally to a manner by which to identify a vehicle by detecting characteristics of a headlight, or other light energy emitted by a vehicle during its operation. More particularly, the present invention relates to a vehicular signaturing apparatus and an associated methodology that is representative of a vehicular identity.

The vehicular signature, once identified, is analyzed pursuant to any of various functionalities, e.g., a security system, a surveying system, a roadway advertising system, a speed calculation system, a vehicular-operation analyzer, or other vehicle-related functionality.

BACKGROUND

Use of automotive, and other, vehicles has long been a primary means of transportation in many parts of the world. Entire industries have been developed, and are in place, relating to the manufacturing and servicing of automotive vehicles. And, many aspects of vehicular use are ingrained into modern culture. Selection of vehicles for purchase and for transport is oftentimes not merely based upon utilitarian considerations but also for stylistic and status considerations.

In just North America, many millions of vehicles are manufactured and sold every year. And many millions more are operated regularly.

Traffic congestion is a regular problem in many areas, particularly during morning and evening commutes. Traffic control and monitoring is regularly made, if not to alleviate congestion, at least to report thereon. Various traffic monitoring and traffic control mechanisms are conventionally used. Many of such mechanisms rely upon visual observation by an observer to view the traffic conditions or patterns. While sometimes entirely adequate, the viewing of the traffic generally requires daylight conditions or lighting conditions that permit the viewing of the vehicular traffic.

Monitoring and identification of vehicles are required pursuant to other functions, for instance, security control at an enterprise, or other, facility. Security at a facility is sometimes provided by limiting the ingress and egress of vehicular traffic to the facility. A security gate, or other access control mechanism, is utilized by which to prevent vehicular entry into, and egress out of, the facility. In various security gate systems, identification of the vehicle is confirmed prior to grant of permission to an operator of the vehicle to enter or leave the facility. The identification is typically visually made, sometimes together with confirmation of the viewed identification with a registry of vehicles permitted in and out of the facility.

Various other vehicular-related functions require the identification of vehicles and yet others would benefit from, or be possible if, vehicular identifications would be more easily obtainable without reliance upon eyesight viewing of the vehicles for their identification.

A significant majority of the vehicles operated in most areas are manufactured by a limited number of manufacturers. While collectively, such manufacturers manufacture and market a relatively significant number of different vehicles, the number is a finite and readily obtainable number. And, different models exhibit identifiable characteristics. Each of the different models has, for instance, common contours, shapes, configurations, and other characteristics, due to their common manufacturer, and typically, use of commonly-supplied or manufactured component parts. Vehicular headlight assemblies are amongst the component parts of vehicles that, for a particular model, are generally of common type, manufactured by a common manufacturer and exhibitive of common characteristics.

If better advantage could be taken of the common characteristics of vehicles of common manufacture and model-type, improved identification and identification-related functionalities would be possible.

It is in light of this background information related to automotive, and other, vehicles that the following disclosure is made.

SUMMARY

The present specification describes an apparatus, and an associated methodology, by which to identify a vehicle by detecting characteristics of headlight, or other, light energy generated by the vehicle during its operation.

Through operation of an embodiment of the principles disclosed herein, a manner is provided by which to obtain a vehicular signature, and an associated methodology, that is representative of a vehicular identity.

In various embodiments, the vehicular signature, once obtained, is analyzed pursuant to any of various functionalities related to vehicular operation, positioning, and movement. Some of these possible embodiments are mentioned below.

A database is formed that includes entries for each of a plurality of vehicular models together with characteristic information that is characteristic of the associated models. The characteristic information includes, for instance, information associated with light generated by vehicular headlamps or headlights that generate light energy during the operation of the vehicle. The characteristics of the light energy are unique to the model-type. Different models have different types of headlamp or headlight assemblies, and the light-generative characteristics thereof differ. As each of the entries of the database contains values representative of characteristics of the headlight or other light energy, the database forms a master listing of vehicular models and their associated light-emittive characteristics. The database is, for instance, maintained at a storage element having electronic, magnetic, or other storage media, by which to store the values that form the database.

A light detector detects light energy emitted by a vehicle during its operation. The detector converts the detected light energy into electrical energy that is representative of the detected light energy. The light energy is detectable both when the vehicle is stationary and also when the vehicle is moving. And, the electrical energy is represented over a range of frequencies and forms, for instance, an acoustic signal representation of the signal light energy.

The acoustic signature, or other representation of the light energy is stored at a temporary storage device, such as an electronic memory cache, or the like. The cached representations are used by a comparator, or values directly applied to the comparator if a storage cache is not utilized. The comparator compares the values representative of the detected light energy with database-stored values associated with the plurality of different vehicular models. The comparator, for instance, iterates through the successive entries of the database in order to locate a stored entry that corresponds to the detected signal energy. If the comparison indicates a match, identification is made of the vehicular type, for example, with respect to its make, model, and year of manufacture.

Information associated with the identified vehicle is provided, i.e., to an analyzer, for further analysis and use by additional vehicular-related functionality. The analysis utilizes the vehicular identification made as a result of the light-energy detection.

The analyzer comprises a security scheme, such as the security scheme utilized at a security gate to an enterprise or other facility. The light energy emitted by a vehicle attempting to enter or egress the facility is compared with master database information to confirm that the vehicle is of a vehicular signature corresponding to that stored in the master database and is further identified to be permitted to enter into, or egress from, the facility.

Analysis is performed pursuant to a surveying functionality. In the surveying functionality, vehicular traffic along a road way, or other traffic route, is monitored. Detection is made of the light energy generated by vehicles that travel along the roadway. Detected information is compared with a master database to identify the types of vehicles that are traveling along the roadway.

Analysis is made pursuant to a speed-determination functionality. Detected light energy is compared with master database information. And, once identified, the speed of the vehicle is calculated by a time over distance algorithm.

The analysis is performed pursuant to a mechanical operability determiner. For a vehicle of known characteristics, measured characteristics, i.e., the light energy, is compared with the master database-stored information. Variance between the measured and stored information is sometimes indicative of the mechanical malfunction of the vehicle. And, responsive to the comparison, remedial action is taken to correct the problem.

In these and other aspects, therefore, a vehicular signaturing apparatus and an associated methodology is provided. A sensor is configured to sense a characteristic indicia of vehicular light energy. An identifier is adapted to receive an indication of the characteristic indicia sensed by the identifier. The identifier is configured to identify vehicular information associated with the characteristic information. An analyzer is adapted to receive the identification made by the identifier. The analyzer is configured to analyze the identification pursuant to a vehicular signaturing functionality.

A more complete appreciation of the scope of the present disclosure and the manner in which it achieves the above-noted and other improvements can be obtained by reference to the following detailed description of illustrative embodiments taken in connection with the accompanying drawings, that are briefly summarized below, and by reference to the appended claims.

DETAILED DESCRIPTION

Figure 1:
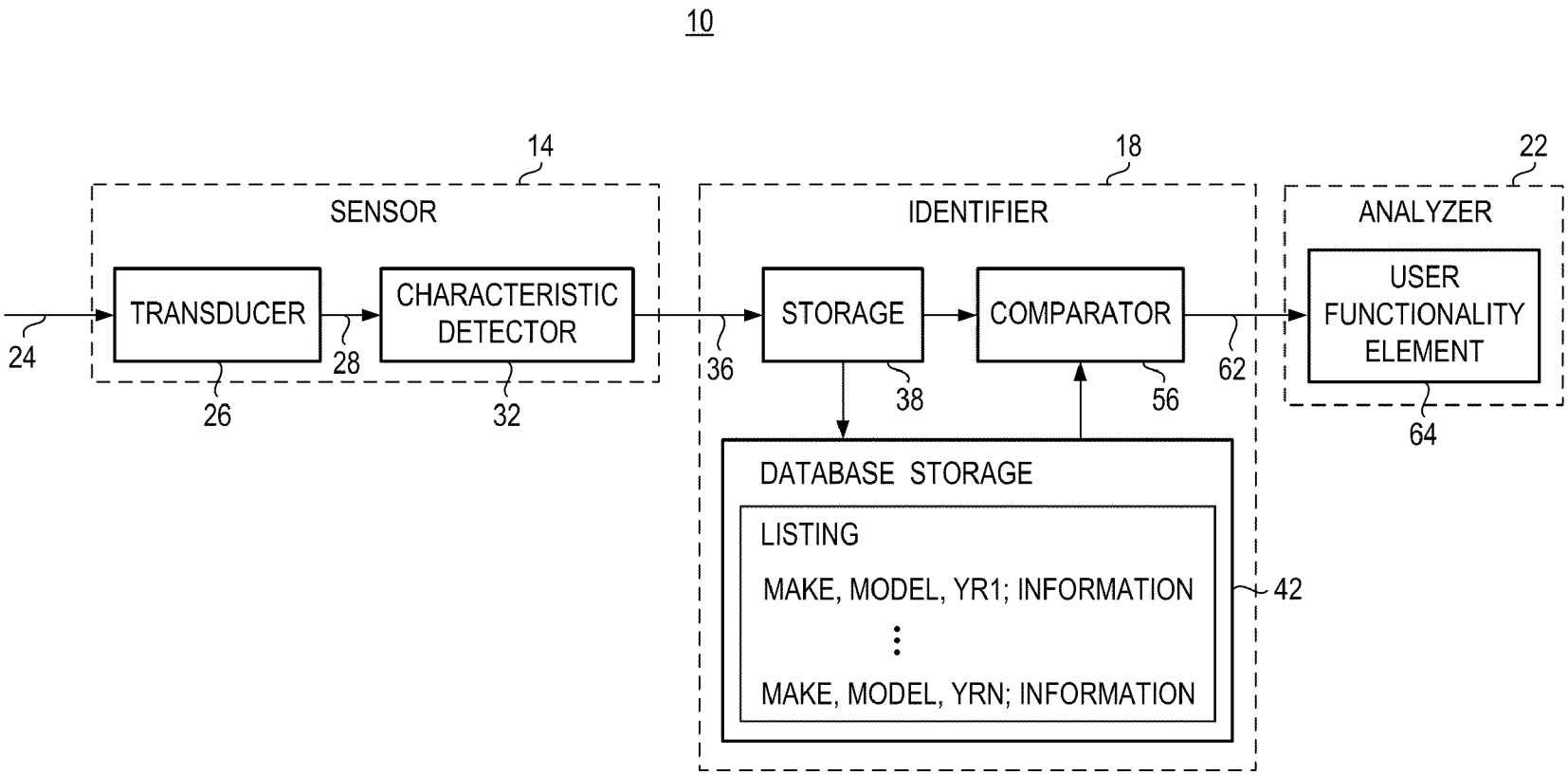
FIG. 1 illustrates a functional block diagram of a vehicular signaturing device.

Referring first to FIG. 1, a vehicular signaturing device, shown generally at 10, operates to detect light energy emitted by a vehicle, such as an automobile, a truck, or other mechanism of transport that is capable of movement. The elements of the vehicular signaturing device are represented functionally and may be implemented as algorithms executable by processing circuitry, hardware devices, or combinations thereof. In one illustrative implementation, elements of the signaturing device are embodied at a single physical location, e.g., housed in a common housing. In another implementation, the vehicular signaturing device is distributed across more than one location. The illustrative implementation shall be described with respect to creation of a vehicular signature of mass-produced automotive vehicles. In other implementations, the vehicular signaturing provided by the device 10 is of other types of vehicles. The device 10 includes a sensor 14, an identifier 18, and an analyzer 22. The sensor 14 operates to sense light energy, here indicated by the line 24, generated by the automotive vehicles, such as the headlamps or headlights of such vehicles. The identifier 18 operates to identify the vehicle based upon the sensed light energy sensed by the sensor 14. And, the analyzer 22 operates to perform further function-specific analysis using the identification provided by the identifier 18.

The sensor 14 includes a light detector or transducer 26 that detects the light energy and transduces the light energy into electrical form on the line 28. The transduced signal is an electrical representation of the light energy. And, the sensor 14 includes a characteristic detector 32 that is provided with the electrical representation generated on the line 28 of the light energy 24. The characteristic detector 32 operates to detect a characteristic indicia of the light energy, as represented by the electrical representation thereof. In the illustrative implementation, the indicia detected by the characteristic detector 32 comprises an acoustic representation, i.e., a magnitude representation over a range of frequencies, of the light energy.

A representation of the detected characteristic indicia, here indicated by the line 36, is provided to a storage element 38 of the identifier 18. The storage element 38 forms, for instance, a memory cache formed of an electronic memory or a magnetic memory. The storage element 38 stores one or more representations provided thereto by way of the line 36. In one implementation, the storage element 38 stores a limited number of representations in a FIFO (First-In, First-Out) memory scheme. In another implementation, a large number of representations are stored, sequentially or otherwise, at the storage element 38.

The identifier 18 further includes a database storage element 42. The data base storage element 42 contains memory locations permitting the storage at the storage element 42 of a master database listing of vehicles together with associated characteristic indicia. Here, the characteristic indicia include indicia of light energy emitted by headlamp or headlights or other light emitting component portions of a plurality of models of vehicles. The master database includes a plurality of entries, each of which identifies a vehicle by its manufacturer, i.e., make, model-type, and year of manufacture. Each of the entries includes values of the characteristic indicia associated generically with the vehicle of the corresponding make, model, and year. The resultant listing ("LISTING" in FIG. 1) includes the plurality of entries each indexing characteristic indicia together with make, model, and year information.

The identifier 18 further includes a comparator 56 that operates to compare a value stored at the storage element 38 with values contained at the listing of the database 42. The comparator 56 compares, such as by way of an iterative procedure, the values retrieved from the storage element 38 with values of each of the entries of the listing in the database 42. In such manner, the comparator 56 determines which entry of the database 42 corresponds, by make, model, and manufacture year, to the vehicle whose light energy is sensed by the sensor 14. Results of the comparison, such as an identification of the make, model, and manufacture year of the vehicle whose light energy is detected is provided, here indicated by way of the line 62, to a user functionality element 64 of the analyzer 22. Due to the correlation of the detected characteristic indicia with the corresponding values of a typical vehicle of corresponding make, model, and year, a signature of the vehicle is obtained.

Figure 2:
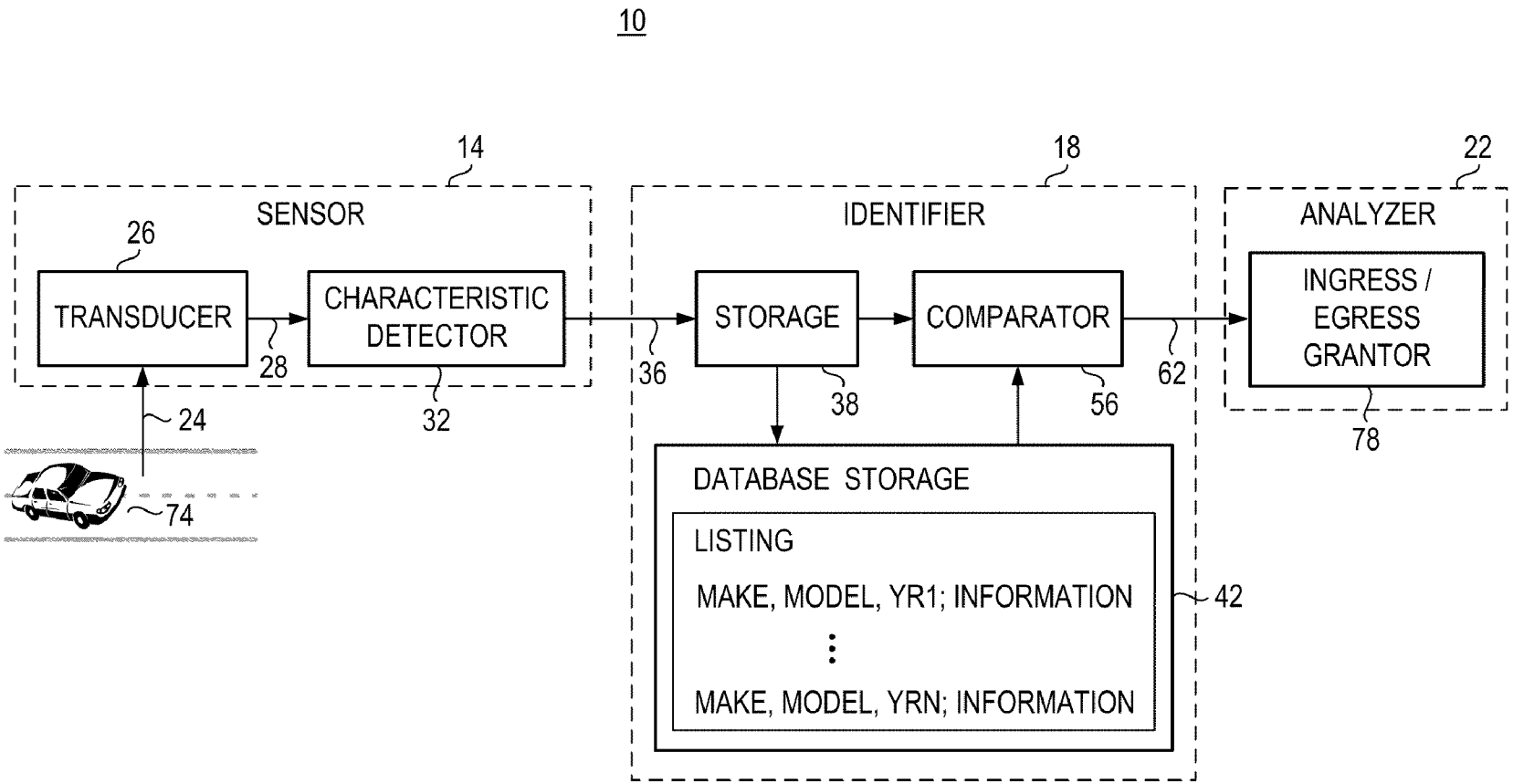
FIG. 2 illustrates a representation of an example implementation in which the vehicular signaturing device is used.

FIG. 2 illustrates an illustrative implementation of the vehicle signaturing device 10. Here, the device 10 is positioned at a security gate that guards entrance to, and egress from, an enterprise facility. Light energy emitted by the headlamps or lights of the vehicle 74 positioned at the security gateway is sensed by the sensor 14 of the device 10, and the vehicle is identified by the identifier 18 of the device 10. Identification of the vehicle is made by the identifier 18, and the identification is provided to a gate ingress/egress grantor 78 of the analyzer 22. The decision to grant passage of the vehicle through the security gate is made, or denied, responsive to the vehicular identification. For instance, the gate entry grantor 78 grants or prohibits passage of the vehicle through the security gate depending upon whether the identified vehicle is listed in an approved listing of vehicles permitted passage through the security gate. The approval may be further dependent upon an operator of the vehicle also being appropriately identified and identified to be associated with the vehicle attempting to pass through the security gate. In this implementation, the device is used as a method of security at a security-style gate. Sensors (e.g. 14) installed at a security entrance read a person's digital vehicular signature and compare it against the vehicular signature that is on file. If the vehicular signature fails to match that of the encoded signature, then access is denied.

Figure 3:
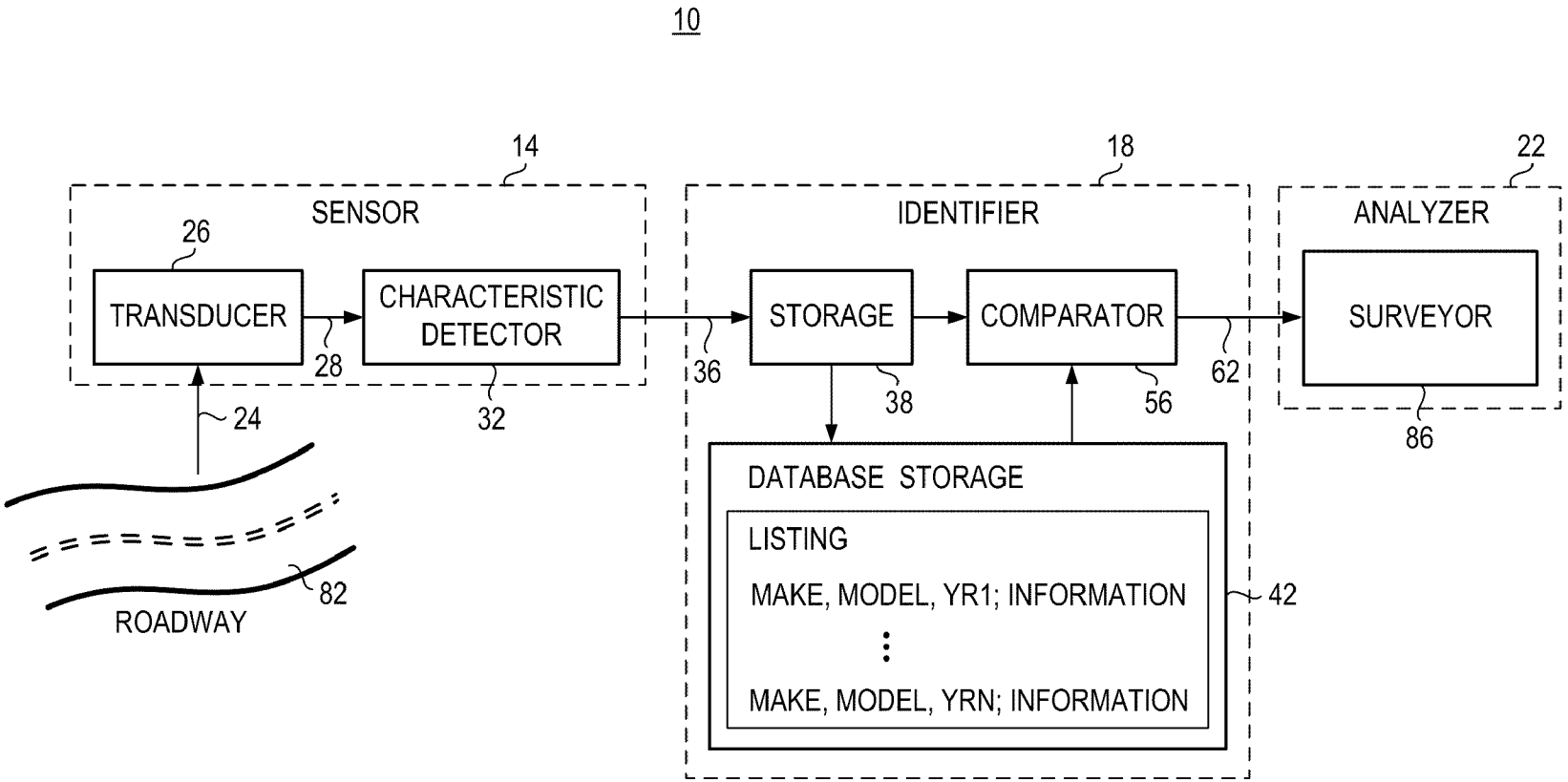
FIG. 3 illustrates another representation of another example implementation in which the vehicular signaturing device is used.

FIG. 3 illustrates another use of the device 10. Here, the device is positioned along a roadway 82 at a location permitting detection of light energy generated by vehicular headlamps and headlights. The sensor 14 of the device senses the light energy emitted by vehicles traveling along the roadway 82. Identification of the vehicles passing along the roadway 82 is made by the identifier 18. And, indications of the identifications made by the identifier 18 are provided, as indicated by line 62, to the surveyor 86 of the analyzer 22. The surveyor 86, for instance, forms a vehicular logger that logs the passage of vehicles. Log entries of a log made by the surveyor 86 are made available for subsequent review to identify the types of vehicles that are traveling along the roadway 82. That is to say, in this implementation, the device 10 is positioned such that, when a vehicle comes by, the device senses the headlight or other light energy of the vehicle, records the sample, and then compares the recorded sample to a data base 42 to look for a signature match. Then, a log is made that counts the vehicle, identifies the manufacturer of the vehicle, and stores that information at the data log. The log can then be used, e.g., by city planners, a road commission, or vehicular manufacturers in their local advertising towards specific types of owners and operators of specific types of vehicles.

Figure 4:
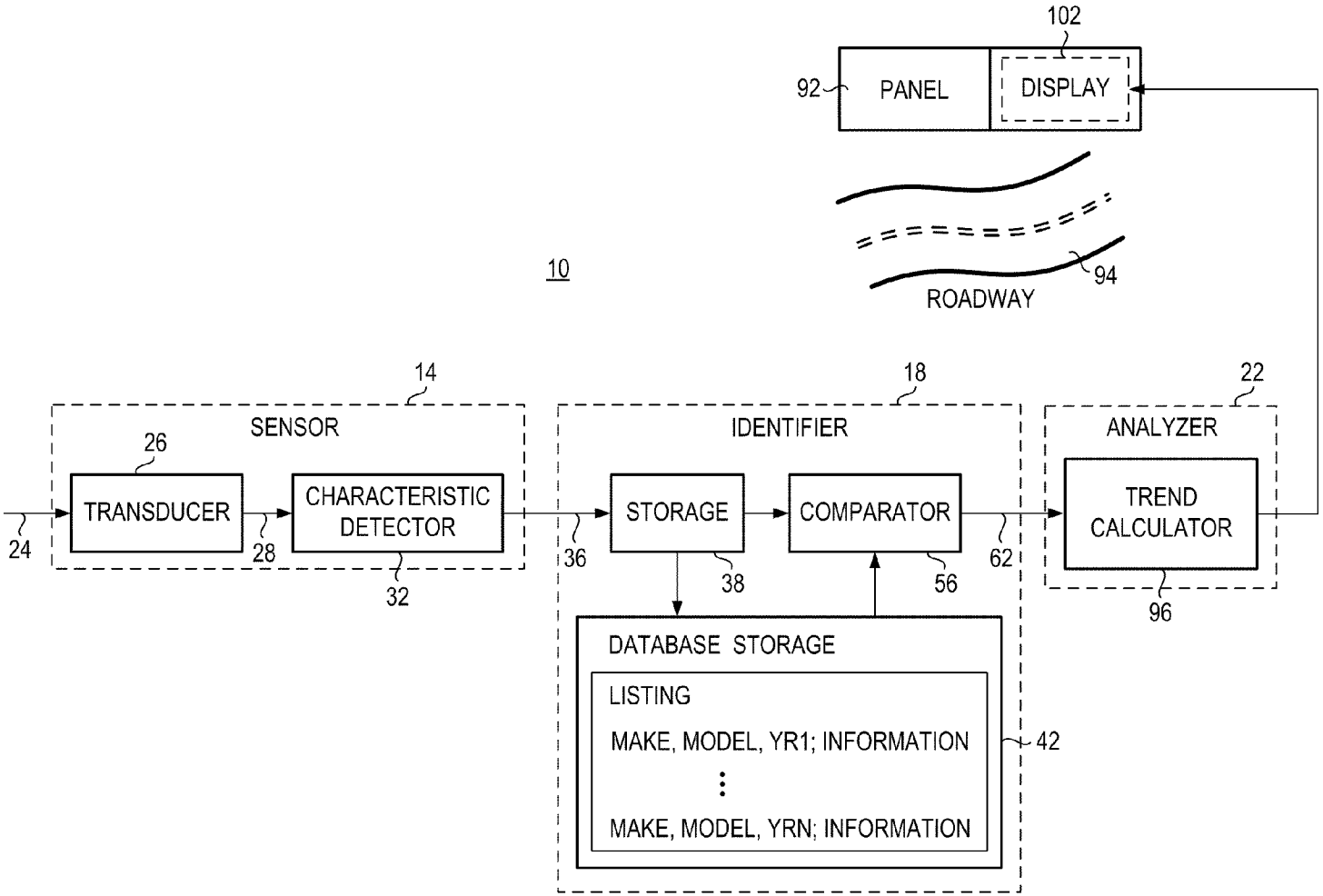
FIG. 4 illustrates another representation of another example implementation in which the vehicular signaturing device is used.

FIG. 4 illustrates implementation of the device 10 pursuant to a roadway advertising scheme. Here, the device 10 is positioned along a roadway 94 and powered, for instance, by a solar power panel 92. The device 10 detects passage of vehicles along the roadway 94 and identifies the vehicular types passing along the roadway 94. Indications of identifications are provided to a trend calculator 96 of the analyzer 22. The trend calculator 96 identifies trends in vehicular passage along the roadway 94. And, responsive to the identified trends, advertising is selected for display at an advertising display 102 along the roadway 94. Because the advertising displayed at the display 102 is tailored to the trend of vehicular passage along the roadway, the advertising is more likely to be appropriate for the vehicles passing along the roadway.

Figure 5:
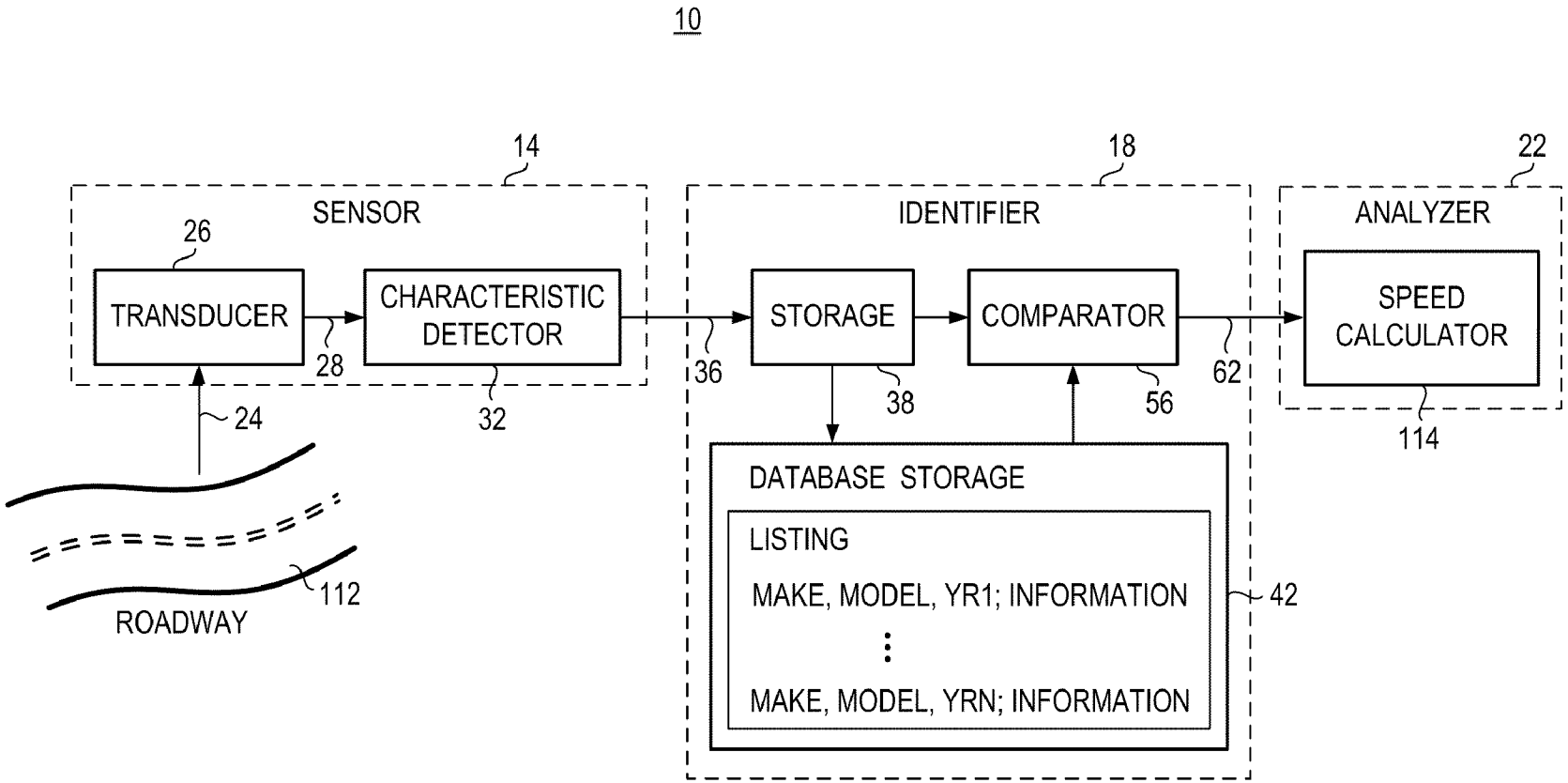
FIG. 5 illustrates a representation of another example implementation in which the vehicular signaturing device is used.

FIG. 5 illustrates use of the vehicular signaturing device 10 in another implementation. Here, the device is positioned along a roadway 112. The device 10 is here positioned to detect light energy generated by vehicles passing along the roadway. The light energy is sensed by the sensor 14, and vehicular identification is made by the identifier 18. And, the analyzer 22 here includes a speed calculator 114 that calculates the speed of the vehicle through calculation of a time over distance formula. Headlight data, e.g., beam distance, is utilized in the calculation.

Figure 6:
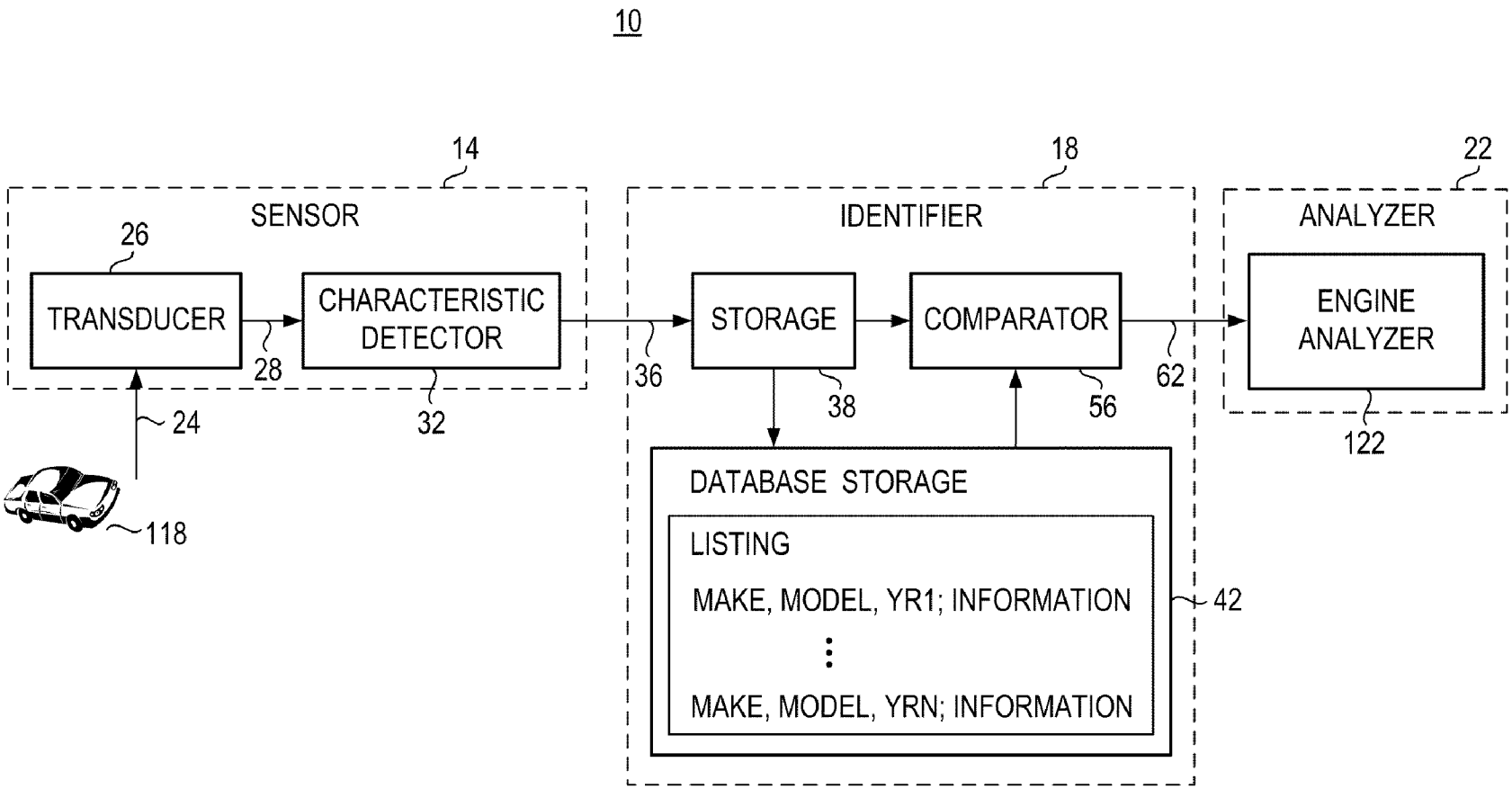
FIG. 6 illustrates a representation of another example implementation in which the vehicular signaturing device is used.

FIG. 6 illustrates another use of the device 10. Here, the device 10 is positioned, again to sense, at the sensor 14 thereof, the light energy emitted by a headlamp or light of the vehicle, here represented by the vehicle 118. The identifier 18 of the device identifies the vehicle 118, and information related to the identification is provided to an engine operational analyzer 122. The engine analyzer 122 analyzes operation of the vehicle based upon the light energy that is detected and comparison to threshold, or base, energy values. That is to say, here, the device 10 is used to identify engine problems of the vehicle 118. If the known signature is not common, is undervalued, is overvalued, etc., by deduction, a determination is made that the engine of the vehicle 118 is running improperly, or otherwise not in conformity with manufactured specifications.

In one implementation, the device 10 operates to determine the state of the electrical system of the vehicle 118. The device 10 analyzes the detected audio file of the light energy, determines the vehicle type, and, by comparing the now-known signature of the vehicle to the master database of signatures, microvoltage drops detected through analysis of the light energy can be compared and identified as to which accessories or systems are on in the vehicle at the time of reporting.

Figure 7:
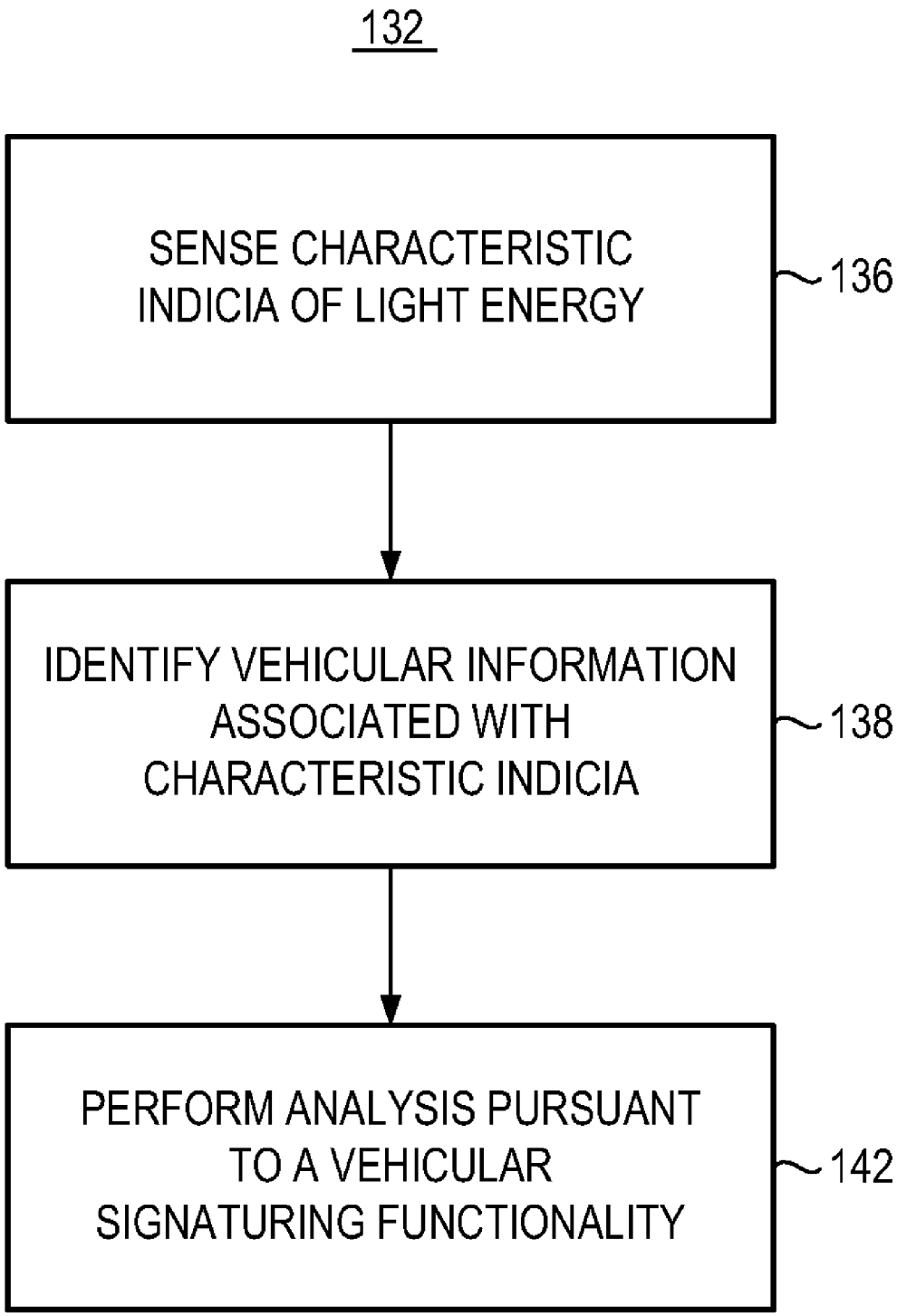
FIG. 7 illustrates a method flow diagram representative of the method of operation of the principles disclosed herein.

FIG. 7 illustrates a method, shown generally at 132, representative of the method of operation of the variety of devices described herein and other examples of the principles described herein. The method 132 facilitates formation of a vehicular signature.

First, and as indicated by the block 136, the characteristic indicia of vehicular light energy is sensed. Then, and as indicated by the block 138, vehicular information associated with the characteristic indicia is identified. Then, and as indicated by the block 142, analysis of the identification is performed pursuant to a vehicular-signaturing functionality.

Thereby, through detection of the light energy emitted by an automotive, or other vehicular, light-emitting element, the vehicular type is identifiable. Once identified, analysis is performed pursuant to a vehicular-signaturing functionality.

The scope of the invention is defined by the following claims.

What is claimed is:

1. A vehicular signaturing apparatus comprising:

a sensor configured to sense characteristic indicia of vehicular light energy from a vehicle;

an identifier adapted to receive an indication of the characteristic indicia sensed by said sensor, said identifier configured to identify vehicular information comprising a make of said vehicle associated with the characteristic indicia; and an analyzer adapted to receive an identification made by said identifier, said analyzer configured to analyze the identification pursuant to a vehicular-signaturing functionality.

2. The vehicular signaturing apparatus of claim 1 wherein said sensor comprises a light transducer configured to transduce detected vehicular light energy into electrical form.

3. The vehicular signaturing apparatus of claim 2 further comprising a characteristic detector configured to detect the characteristic indicia of the vehicular light energy.

4. The vehicular signaturing apparatus of claim 1 wherein the vehicular light energy sensed by said sensor comprises vehicular headlamp light energy.

5. The vehicular signaturing apparatus of claim 1 wherein said characteristic indicia is represented by a magnitude representation over a range of frequencies of the light energy.

6. The vehicular signaturing apparatus of claim 1 wherein said vehicular information further comprises a model of said vehicle.

7. The vehicular signaturing apparatus of claim 1 wherein said identifier comprises a characteristic-indicia storage element configured to store the indication of the characteristic indicia.

8. The vehicular signaturing apparatus of claim 7 wherein said identifier further comprises a database storage element configured to store database information of master vehicle information of a plurality of vehicles.

9. The vehicular signaturing apparatus of claim 1 wherein said identifier further comprises a comparator configured to compare the indication of the characteristic indicia with entries in a database containing master vehicle information to obtain the vehicular information associated with the characteristic indicia.

10. The vehicular signaturing apparatus of claim 9 wherein said analyzer receives an indication of the comparison made by said comparator and conducts an, analysis pursuant to the vehicular-signaturing functionality utilizing the indication of the comparison.

11. The vehicular signaturing apparatus of claim 1 wherein said analyzer comprises a security verifier configured to verify that said vehicular information indicates a vehicle that is authorized to pass a security checkpoint.

12. The vehicular signaturing apparatus of claim 1 wherein said analyzer comprises a vehicular surveyor that keeps a log of said vehicular information for vehicles passing a checkpoint on a roadway.

13. The vehicular signaturing apparatus of claim 1 wherein said analyzer comprises a media displayer configured to display selected media, said media being selected in response to the vehicular information produced by said identifier.

14. The vehicular signaturing apparatus of claim 1 wherein said analyzer comprises a speed determiner.

15. The vehicular signaturing apparatus of claim 1 wherein said analyzer further receives said indication of the characteristic indicia sensed by said sensor via an output of said identifier and comprises a mechanical fault detector for detecting a mechanical fault of said vehicle based on said vehicular light energy sensed by said sensor.

16. A method for signaturing a vehicle, said method comprising:

sensing characteristic indicia of vehicular light energy from a vehicle;

identifying vehicular information associated with the characteristic indicia, said vehicular information comprising a make of said vehicle; and analyzing the vehicular information pursuant to a vehicular-signaturing functionality.

17. The method of claim 16 wherein said sensing comprises sensing a magnitude over a range of frequencies of the vehicular light energy.

18. The method of claim 16 wherein said sensing comprises sensing vehicular headlight energy.

19. The method of claim 16 wherein said identifying comprises comparing the characteristic indicia with a master vehicular-information database.

20. An apparatus for identifying a vehicular signature, said apparatus comprising:

a light-energy recorder configured to record characteristic indicia of vehicular light energy from a vehicle;

a storage element configured to store a vehicular-information database containing a plurality of vehicle data entries; and a comparator configured to compare the characteristic indicia of the vehicular light energy with vehicle data entries stored at said storage element to identify a make of said vehicle.

* * * * *